US006962451B2

(12) United States Patent
Narita et al.

(10) Patent No.: US 6,962,451 B2
(45) Date of Patent: Nov. 8, 2005

(54) CARRIER DEVICE FOR THERMAL TRANSFER MEDIUM, DISCRIMINATION METHOD USING THE SAME, AND PRINTER

(75) Inventors: Satoshi Narita, Tokyo (JP); Koji Eto, Tokyo (JP); Kazutoshi Awano, Tokyo (JP); Daisuke Matsuura, Tokyo (JP); Hideshi Hattori, Tokyo (JP)

(73) Assignee: Dai Nippon Printing Co, Ltd, Tokyo-to (JP)

( * ) Notice: Subject to any disclaimer, the term of this patent is extended or adjusted under 35 U.S.C. 154(b) by 0 days.

(21) Appl. No.: 10/446,757

(22) Filed: May 28, 2003

(65) Prior Publication Data

US 2004/0005180 A1 Jan. 8, 2004

(30) Foreign Application Priority Data

May 28, 2002 (JP) ..... 2002-154657
Feb. 28, 2003 (JP) ..... 2003-053878

(51) Int. Cl.[7] ..... B41J 35/28

(52) U.S. Cl. ..... 400/207; 400/208; 400/242; 347/178

(58) Field of Search ..... 400/120.01–120.03, 400/191, 196, 207, 239–241.1, 242–245, 248.3, 249, 208; 347/171, 172, 104–106, 278

(56) References Cited

U.S. PATENT DOCUMENTS 4,910,533 A * 3/1990 Sasaki et al. ..... 347/178
5,290,114 A * 3/1994 Asami et al. ..... 400/208
5,352,049 A * 10/1994 Shiraishi et al. ..... 400/208
5,393,149 A * 2/1995 Iima ..... 400/208
5,774,639 A * 6/1998 Schildkraut et al. ..... 358/1.16
6,380,965 B1 4/2002 Sims et al.
6,387,846 B1 5/2002 Shinozaki et al.
6,467,869 B1 * 10/2002 Merz et al. ..... 347/19
6,676,312 B2 * 1/2004 Richard ..... 400/242

FOREIGN PATENT DOCUMENTS

EP 2001105703 4/2001

* cited by examiner

*Primary Examiner*—Minh Chau
(74) *Attorney, Agent, or Firm*—Timothy J. Keefer; Seyfarth Shaw LLP

(57) ABSTRACT

The invention provides a carrier device for a thermal transfer medium comprising a spool for winding and supporting a thermal transfer sheet or a thermal transfer receiving sheet, wherein a mark containing a coloring material which absorbs an electromagnetic wave of a predetermined wavelength $\lambda 1$ and emitting an electromagnetic wave of a wavelength $\lambda 2$ different from the wavelength $\lambda 1$ is provided on a region in a surface of the carrier device capable of being irradiated with an electromagnetic wave. The invention provides a discrimination method and a printer each of which utilizes such a carrier device capable of executing at least one process among the kind identification, the fake goods determination and the use amount calculation for the thermal transfer sheet or the thermal transfer receiving sheet based on a detection of the mark.

17 Claims, 6 Drawing Sheets

CARRIER DEVICE FOR THERMAL TRANSFER MEDIUM, DISCRIMINATION METHOD USING THE SAME, AND PRINTER

BACKGROUND OF THE INVENTION

1. Field of the Invention

The present invention relates to a carrier device for a thermal transfer medium. More specifically, it relates to a carrier device which is provided with at least a spool for winding and supporting a thermal transfer medium including a thermal transfer sheet and/or a thermal transfer receiving sheet, and may be further provided with other parts such as a cassette for supporting the spool, which is capable of providing an effective means for identifying the kinds, determining fake goods, calculating the use amount, or the like.

The present invention also relates to a method and apparatus for identifying the kinds of a thermal transfer sheet or a thermal transfer receiving sheet, determining fake goods, and detecting the use amount, using the above-mentioned carrier device.

2. Description of the Related Art

A thermal transfer sheet comprises a substrate film or sheet which is usually a plastic film made of a polyethylene terephthalate or the like, one surface of which is provided with a thermal fusible coloring material transfer layer made of a pigment or a dye and a binder resin or the like, or a thermal diffusible coloring material transfer layer, and the other surface of which may be provided with a thermal resistant lubricant layer. This is in general supported by a cylindrical spool (or a "reel" in the other word) in a state wound around for a desired length or for a length of a predetermined number of displaying frame so as to be mounted on a predetermined printer and used. The above-mentioned spool is in most cases made of a paper or a resin. The spool is sometimes equipped with accessory portions such as a gear, a notch, or a collar, a flange or the like for the need in terms of drive or for the convenience in terms of mounting on a printer or a cassette. Moreover, depending on the printer, a cassette (or a "cartridge" in other word) storing the spool winding and supporting a thermal transfer sheet together with the other spool for winding up a consumed thermal transfer sheet is used.

As a consequence of the advance of the thermal transfer recording technique, the kinds of the thermal transfer sheets vary widely.

More specifically, in the case of the thermal fusible transfer sheet, a type using a black pigment mainly used for a facsimile, a bar code printer, or the like is the mainstream, but depending on the application, there are also a color type of a red, blue or green color, and a so-called special color (or "exclusive color") type such as a gold, silver or a fluorescent color.

In the case of the thermal diffusible transfer sheet, a type having coloring material transfer layers of the three primary colors of yellow, magenta and cyan for a color printer each successively in the surface is basic, but there are also many kinds such as a type further added with a black coloring material transfer layer, a type added with a transferable protection layer, and a type added with a black thermal fusible transfer layer. Furthermore, there is a single color thermal transfer sheet having each coloring material transfer layer alone, and these many kinds of the thermal transfer sheets are often provided at the same time for one type of a printer according to the application.

In the case where the kinds of the thermal transfer sheets varies widely as mentioned above, identification of the kind is an important issue. For example in the case of thermal transfer recording, a thermal transfer sheet and a thermal transfer receiving sheet are used in combination, and the combination is fixed in most cases individually. More specifically, a thermal transfer receiving sheet to be not provided with the protection layer is combined with a thermal transfer sheet not having a transferable protection layer, and one of a type to be provided with the protection layer is combined with a thermal transfer sheet having a transferable protection layer. If the combination is mistaken, not only expected printing performance and durability cannot be obtained but also it may cause a malfunction or breakdown of the printer. Additionally, in the case of a printer using single color thermal transfer sheets having each coloring material transfer layer individually as mentioned above, it is the major premise that a plurality of different thermal transfer sheets are mounted correctly at the predetermined mounting positions.

Conventionally, the kind of the thermal transfer sheet has been identified according to a method of applying different colors for each type of a spool or a cassette supporting the thermal transfer sheet, applying a kind code or an abbreviated name, providing a machine identification code such as a bar code, or the like. Moreover, in addition thereto, a method of changing the shape corresponding to each kind within an extent not to hinder the function of the spool or the cassette, that is, by providing or not providing a notch or changing the number thereof, or the like is also known.

However, each of these methods has been required for improvement. The change of the color of the spool or the cassette has limitation in terms of the kinds of the colors to be used practically. Moreover, by preparing a large number of kinds of the spools of different colors, consequently increase in cost of the spool or the cassette is brought about. Furthermore, in some cases it is not preferable in terms of the design of the spool or the cassette. In the case of applying a kind code or an abbreviated name, label attachment is commonly used as the method therefor. However, a label is an extra member inherently not relating to the function of the spool or the cassette. Moreover, by adding the attaching process, the entire processes are complicated, causing increase in cost.

Moreover, since miniaturization of the printers is promoted recently, so that miniaturization of the members such as the spool and the cassette is accelerated as well, the area for attaching the label may be absent. The same problem arises in application of the bar code. Furthermore, it may not be preferable in terms of the external appearance. The change in the shape of the spool or the cassette has the same problems as in the case of the change in color.

As the thermal transfer receiving sheet, although those cut into a predetermined size of the A4 size, the A6 size, or the like have conventionally been the mainstream, those formed in a longitudinal roll-like shape and wound around and supported on a spool are also commercially available for business use. As to the roll-like thermal transfer receiving sheets, a plurality of kinds are present depending on the applications so that the same problems are involved in terms of the kind identification as in the case of the thermal transfer sheet.

Moreover, recently, with the spread of the thermal transfer recording technique, fake goods of the thermal transfer recording materials are found. The fake goods include not only a typical fake falsifying a trade name or a quality of the product, but also a product which is not a genuine goods for a target printer or, is not officially approved an adaptability by a maker or dealer of a printer or, does not satisfy compatibility for a target printer. Conventionally, not many cases are known as to the methods for determining the fake goods in the present situation.

Additionally, in the case of the above-mentioned roll-shaped thermal transfer sheet or thermal transfer receiving sheet, unlike those of the kind preliminarily cut in a desired size, the use amount thereof can hardly be detected in some cases.

SUMMARY OF THE INVENTION

In view of the above-mentioned problems, an object of the present invention is to provide a carrier device for a thermal transfer medium such as a thermal transfer sheet, a thermal transfer receiving sheet or the like, capable of appropriately identifying the kind of the thermal transfer medium or, capable of determining fake goods of the thermal transfer medium or, capable of detecting the use amount of the thermal transfer medium without the cost rise or the external appearance deterioration.

In order to achieve the above object, according to a first aspect of the present invention, there is provided a carrier device for a thermal transfer medium comprising a spool for winding and supporting a thermal transfer sheet or a thermal transfer receiving sheet, wherein a mark containing a coloring material which absorbs an electromagnetic wave of a predetermined wavelength $\lambda 1$ and emitting an electromagnetic wave of a wavelength $\lambda 2$ different from the wavelength $\lambda 1$ is provided on a region in a surface of the carrier device capable of being irradiated with an electromagnetic wave.

The mark of the carrier device may be provided on a part or the entirety of the surface of the spool, and if the carrier device further comprises a cassette supporting or storing the spool, the mark may be provided on a part or the entirety of the surface of the cassette.

It is preferable that the mark has the same color as the part other than the mark, or colorless or white so as to be substantially invisible.

As the coloring material for the mark, any one of the followings is preferably used:

(1) The coloring material which absorbs an ultraviolet ray as the electromagnetic wave of the wavelength $\lambda 1$, and emits a visible light as the electromagnetic wave of the wavelength $\lambda 2$;

(2) The coloring material which absorbs an infrared ray as the electromagnetic wave of the wavelength $\lambda 1$, and emits an infrared ray of the other wavelength as the electromagnetic wave of the wavelength $\lambda 2$; and, (3) The coloring material which absorbs an infrared ray as the electromagnetic wave of the wavelength $\lambda 1$, and emits a visible light as the electromagnetic wave of the wavelength $\lambda 2$.

Particularly in the case of using the coloring material of the above (3), namely the coloring material absorbing an infrared ray as the wavelength $\lambda 1$and emitting a visible light as the wavelength $\lambda 2$, it is preferable that the coloring material to be used is made of fine particles containing rare earth element which has the up conversion light emission to be excited by a light of a wavelength in the range of 500 nm to 2,000 nm.

The fine particles containing rare earth element preferably have a mean particle size in the range of 1 nm to 100 nm.

The fine particles containing rare earth element preferably contains a base material composed of at least a halide and/or an oxide and the rare earth element having the up conversion light emission.

A preferable example of the rare earth element in the fine particles is at least one selected from the group consisting of an erbium (Er), a holmium (Ho), a praseodymium (Pr), a thulium (Tm), a neodymium (Nd), a gadolinium (Gd), an europium (Eu), an ytterbium (Yb), a samarium (Sm) and a cerium (Ce).

When the coloring material absorbing an infrared ray as the wavelength $\lambda 1$ and emitting a visible light as the wavelength $\lambda 2$ is used, the mark can be imparted with a specific emission color of the up conversion light emission corresponding to a composition of the rare earth element in the fine particles.

According to a second aspect of the present invention, there is provided a discrimination method for a thermal transfer medium, which comprises steps of:

providing the above described carrier device for a thermal transfer medium;

irradiating the mark with the electromagnetic wave of the wavelength $\lambda 1$;

detecting the mark by confirming the electromagnetic wave of the wavelength $\lambda 2$ emitted from the mark; and, executing at least one process among the kind identification, the fake goods determination and the use amount calculation for the thermal transfer sheet or the thermal transfer receiving sheet based on a detection of the mark.

According to a third aspect of the present invention, there is provided a printer comprising:

a sensor for detecting a mark by irradiating the mark with an electromagnetic wave of a wavelength $\lambda 1$ and receiving an electromagnetic wave of a wavelength $\lambda 2$ emitted from the mark, when the above described carrier device for a thermal transfer medium is mounted on the printer, an discriminating part for executing at least one process among the kind identification, the fake goods determination and the use amount calculation for the thermal transfer sheet or the thermal transfer receiving sheet based on a detection signal of the mark, and, a control part for deciding the printing operation based on an discriminating result.

According to the present invention, since a mark is provided on the carrier device by using a coloring material absorbing an electromagnetic wave of a wavelength $\lambda 1$ and emitting an electromagnetic wave of a different wavelength $\lambda 2$, the kind-identification, the fake goods-determination, and the use amount-calculation of the thermal transfer medium can be executed appropriately without increasing the kinds of the parts of the carrier device such as a spool or a cassette, or deteriorating the external appearance.

DETAILED DESCRIPTION OF THE PREFERRED EMBODIMENT

A carrier device for a thermal transfer medium of the present invention is composed of at least spool for winding and supporting a thermal transfer sheet or a thermal transfer receiving sheet, and a mark is provided on a region in a surface of the carrier device capable of being irradiated with an electromagnetic wave. The mark is formed by an appropriate method such as any printing method and contains a coloring material for detecting the mark. It is to be noted that the carrier device fundamentally comprises the spool, and it maybe composed only of the spool. In addition, the plural marks maybe provided to the carrier device as required.

The carrier device of the present invention is characterized by use of the coloring material which absorbs an electromagnetic wave of a predetermined wavelength $\lambda 1$ and emitting an electromagnetic wave of a wavelength $\lambda 2$ different from the wavelength $\lambda 1$.

The mark of the carrier device is detected by irradiating the mark with an electromagnetic wave of a wavelength $\lambda 1$ to excite the coloring material, and then confirming emission of an electromagnetic wave of a wavelength $\lambda 2$ from the mark which is due to the excitation of the coloring material.

The thermal transfer medium to be stored in the carrier device may be various types or kinds of thermal transfer sheet and thermal transfer receiving sheet. In a typical case, thermal transfer sheet is one to transfer a visible image, and thermal transfer receiving sheet is one to be formed with a visible image, However, materials to be transferred from the thermal transfer sheet to the thermal transfer receiving sheet is not limited to the image or visible ink, and it may be another material such as protect layer.

A position of the mark is not limited to a specific region as long as it can be detected by irradiation of the electromagnetic wave. Though the mark is typically formed on the supplying spool or the cassette, it may be formed on another position, such as a region on a surface of a retrieve spool for winding a consumed thermal transfer sheet.

Hereinafter, with reference to preferred embodiments, the present invention will be explained in further detail.

Figure 1:
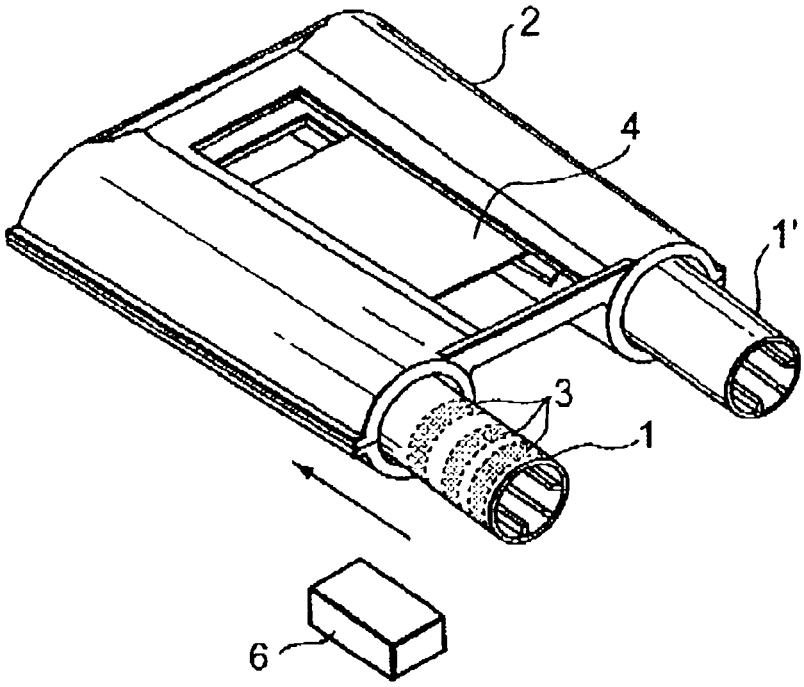
FIG. 1 is a schematic perspective view showing an embodiment of a carrier device of the present invention, which is characterized by a spool.

FIG. 1 is a schematic perspective view showing an embodiment of a carrier device of the present invention, which is particularly characterized by a spool provided with a mark.

Spools 1, 1' are supported by a cassette 2 such that the spool 1 for supplying a thermal transfer sheet 4 in a wound state, and the spool 1' connected, by bonding or another way, with the end of the wound thermal transfer sheet 4 for winding up the same are stored in the cassette 2 . A mark 3 is provided on a part of the surface of the spool 1. The mark 3 contains a coloring material which can absorb an electromagnetic wave of a wavelength $\lambda 1$ and can emit, in response to irradiation of wavelength $\lambda 1$, an electromagnetic wave of a wavelength $\lambda 2$ different from the wavelength $\lambda 1$. Moreover, a sensor 6 is shown in FIG. 1. The sensor 6 detects the mark 3 provided on a part of the spool 1. Though the spool 1 is stored in the cassette 2, a part provided with the mark 3 is exposed from the cassette 2, so that a process for identifying the kind of the thermal transfer sheet 4 wound around on the spool and a process for determining fake goods can be carried out. The sensor 6 is provided on the printer side in usual, and it may be present separately from the printer.

In FIG. 1, as to the detection of the mark 3 by the sensor 6, at the time of mounting the cassette 2 which stores the spool 1 with the thermal transfer sheet 4 wound around and the spool 1 ' connected with the end of the wound up thermal transfer sheet 6 on the printer by moving the same in the arrow direction in FIG. 1, the mark 3 provided on the surface of the spool 1 is detected by the sensor 6, so that the detection signal is compared with predetermined data in the discriminating part provided in the printer so as to identify the kind of the mounted thermal transfer sheet 4 or determine whether or not it is a fake goods. In this case, the sensor 6 is a photo sensor which is composed of at least a light emitting part to emit a light for irradiating the mark 3 and a light receiving part to receive a reflected light of the emitted light by the mark 3. The light emitting part is designed so as to generate an electromagnetic wave of a wavelength $\lambda 1$, and the light receiving part is designed so as to detect an electromagnetic wave of a different wavelength $\lambda 2$ different from the wavelength $\lambda 1$.

Moreover, as the mark detection by a sensor, it is also possible to detect a pattern information such as a bar code or the like imparted with an information concerning a kind of the thermal transfer sheet or an information concerning whether a fake goods or a genuine goods by using a CCD sensor, and then determine an identification of a kind of the thermal transfer sheet or an determination of fake or genuineness of the thermal transfer sheet by comparing the detected data with predetermined data in the discriminating part of the printer.

Figure 2:
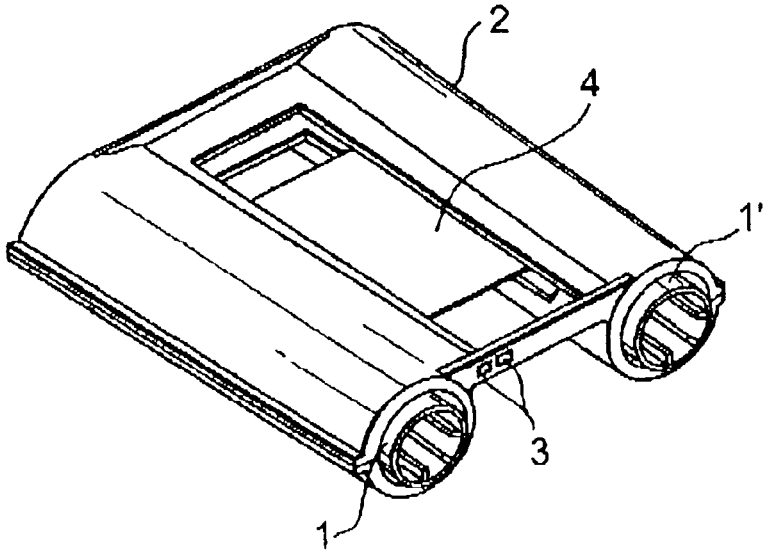
FIG. 2 is a schematic perspective view showing an embodiment of a carrier device of the present invention, which is characterized by a cassette.

Moreover, FIG. 2 is a schematic perspective view showing an embodiment of a carrier device of the present invention, which is characterized by a cassette provided with a mark. In this embodiment, a spool 1 for supplying a thermal transfer sheet 4 in a wound state, and a spool 1 ' bonded with the end of the wound up thermal transfer sheet 4 for winding up the thermal transfer sheet 4 are stored in a cassette 2. A mark 3 is provided in apart of the surface of the cassette 2, and the mark 3 contains a coloring material which absorbs an electromagnetic wave of a wavelength $\lambda 1$ and emits an electromagnetic wave of a different wavelength $\lambda 2$ due to absorbing of the electromagnetic wave of the wavelength $\lambda 1$. Although it is not shown in the figure, at the time when the cassette is mounted on the printer, the mark 3 provided on the cassette 2 is detected by a sensor provided on the printer side, so that a process for identifying the kind of the thermal transfer sheet 4 supported by the cassette 2 or, for determining the fake goods can be executed.

Figure 3:
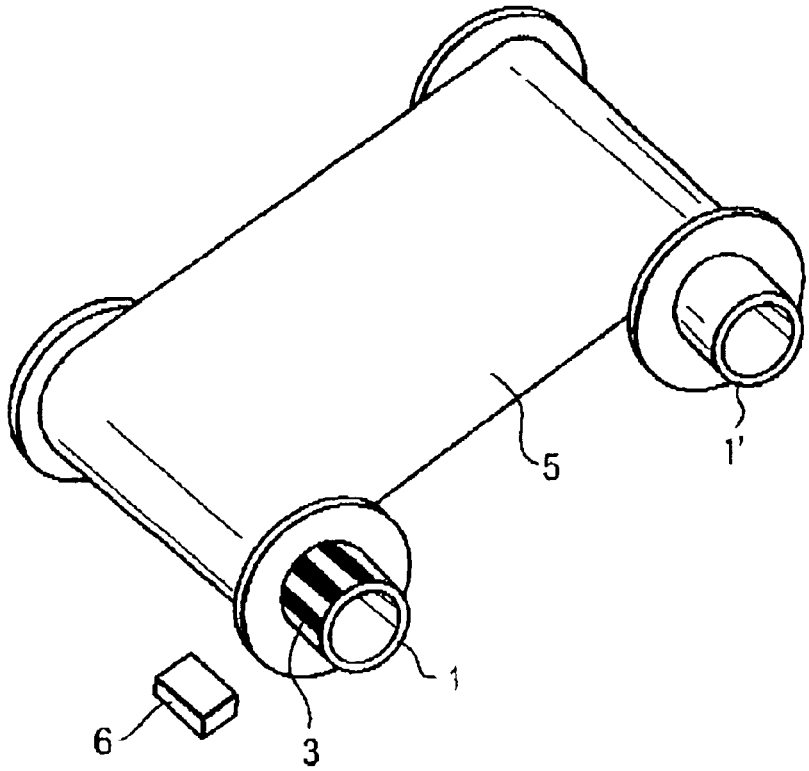
FIG. 3 is a schematic perspective view showing another embodiment of a carrier device of the present invention, which is characterized by a spool.

FIG. 3 is a schematic perspective view showing another embodiment of a carrier device of the present invention, which is characterized by a spool provided with a mark. It is composed of at least a spool 1 for supplying a thermal transfer receiving sheet in a wound state, and a spool 1' bonded with the end of the wound thermal transfer receiving sheet 5 for winding up the thermal transfer receiving sheet 5, with the spool 1 and the spool 1' interlocked by the thermal transfer receiving sheet. A mark 3 is provided in a part of the surface of the spool 1, and the mark 3 contains a coloring material which can absorb an irradiated electromagnetic wave of a wavelength λ1 and can respond to the irradiation by emitting an electromagnetic wave of a wavelength λ2 different from the wavelength λ1. Moreover, a sensor 6 is shown in FIG. 3. The mark 3 provided on the spool 1 is detected by the sensor 6, so that a process for identifying the kind of the thermal transfer receiving sheet 5 wound around on the spool or, for determining the take goods can be executed.

Moreover, since the mark is provided on the spool which rotates at the time of printing, it is also possible to execute a use amount calculation process by counting the number of the mark detection according to the rotation of the spool, and calculating the use amount of the thermal transfer sheet or the thermal transfer receiving sheet wound around the spool from the number of the mark detection by a predetermined calculating equation.

The use amount of the thermal transfer sheet can be calculated relatively easily since the spool with the thermal transfer sheet wound around rotates in a given direction.

However, according to the rotation of the spool with the thermal transfer receiving sheet wound around, in the case where an image with a plurality of colors is formed on the image receiving sheet, an image is formed by overprinting per each color in such manner that an image is first formed with one color and after finishing an image formation of the first color, the operation of rewinding the spool by the backward rotation is introduced before starting image formation of a next color. In this case, it is therefore preferable to determine and count only specific one out of marks provided on the spool, and detect the rotation in only one direction using a rotation sensor.

Though the sensor 6 is provided on the printer side in this embodiment, the sensor may be disposed at a place separate from the printer. For the kind identification or the fake goods determination of the thermal transfer receiving sheet, the relationship between the sensor and the mark as explained in the kind identification or the fake goods determination for the above-mentioned thermal transfer sheet can be adopted similarly.

Figure 4:
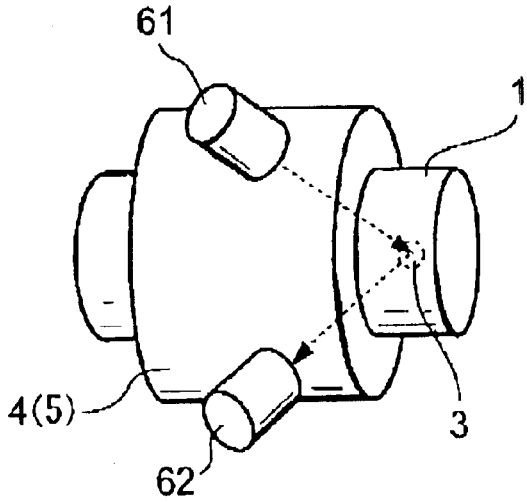
FIG. 4 is a schematic perspective view showing another embodiment of a carrier device of the present invention, which is characterized by a spool.

Moreover, FIG. 4 is a schematic perspective view showing another embodiment of a carrier device of the present invention, which is characterized by a spool provided with a mark. It is a spool 1 for supplying a thermal transfer sheet 4 in a wound around state. A mark 3 is provided in a part of the surface of the spool 1 such that the mark 3 is provided by one per cycle of the spool circumference. In the thermal transfer printer, the spool 1 is rotated according to a printing operation, so that the mark 3 is detected one time per one rotation of the spool 1. As to the mark 3 detection, an electromagnetic wave of a wavelength λ1 as a light generated by and emitted from a light emitting part 61 is irradiated to the mark 3, the irradiation light is reflected by the mark part, and the reflected light is detected by a light receiving part 62. The light receiving part detects an electromagnetic wave of a wavelength λ2 as the reflected light which is different from the wavelength λ1.

By counting the number of the mark detection according to the rotation of the above-mentioned spool, and based on the counted number of the mark detection, the use amount of the thermal transfer sheet or the thermal transfer receiving sheet wound around on the spool is calculated by a predetermined calculating equation, whereby making it possible that the calculated result can be displayed by a printer or, sounding of an alert buzzer or lighting of an alert lamp can be started when the calculated value reaches at a designated remaining amount.

Figure 5:
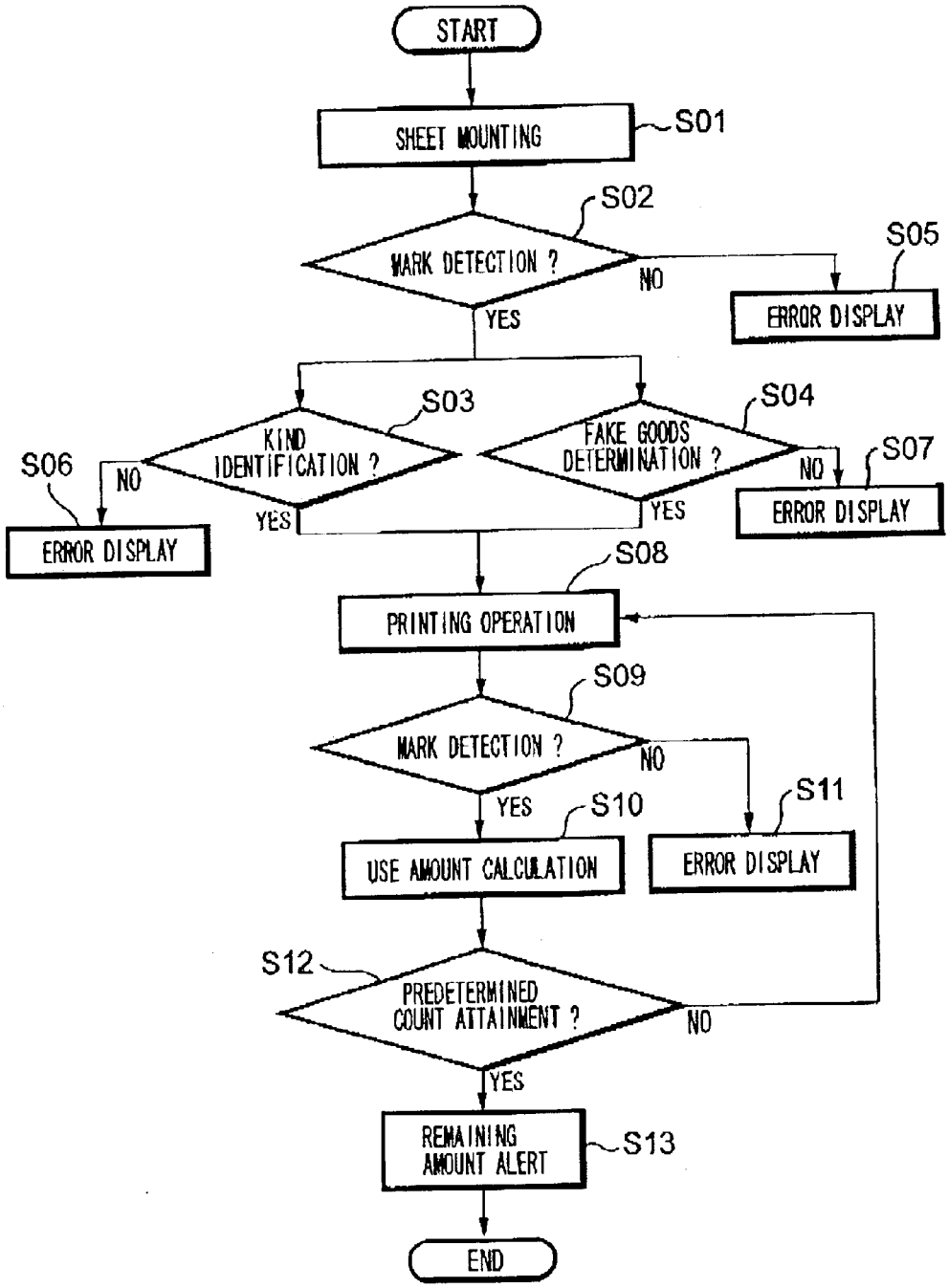
FIG. 5 is a flow chart showing an example of a method for the identification process of the kind of a thermal transfer sheet or a thermal transfer receiving sheet and fake goods, and the use amount calculation process of the sheet.

Next, with reference to a flow chart of FIG. 5 showing an example of a method for an identification process of the kind and a determination process of the fake goods for a thermal transfer sheet or a thermal transfer receiving sheet, and a sheet use amount calculation process, the discrimination method of the present invention will be explained.

A spool for winding and supporting a thermal transfer sheet or a thermal transfer receiving sheet, or a cassette for supporting the spool is mounted on a thermal transfer printer so as to supply the thermal transfer sheet or the thermal transfer receiving sheet to the printer (step S01 ).

Next, an electromagnetic wave of a wavelength λ1 is emitted from the sensor for detecting a mark provided in a part or the entirety of the surface of the above-mentioned spool or cassette. The irradiated light is reflected so that a detection or no detection of an electromagnetic wave of a wavelength λ2 is confirmed by a light receiving part which is a member to detect an electromagnetic wave of a wavelength λ2 different from λ1 (step S02 ).

According to the detection determination result in the above-mentioned step S02, in the case where detection of an electromagnetic wave of a wavelength λ2 is confirmed (S02 : YES), the mark detection signal is compared with predetermined data at a discrimination part provided in the printer so as to identify the kind of the thermal transfer sheet or the thermal transfer receiving sheet (step S03). Moreover, whether or not the thermal transfer sheet or the thermal transfer receiving sheet is a fake goods is confirmed (step S04).

Furthermore, in the case where detection of an electromagnetic wave of a wavelength λ2 is not confirmed (S02 : NO), the detection result is transmitted from the discriminating part provided in the printer to a control part so that an error display is provided on a display part of the printer (step S05), or the printer operation is stopped.

In the case where the results in the above-mentioned steps S03 and S04 are both suitable (preferable) according to comparison with the predetermined data in the discriminating part, the next printing operation in the thermal transfer printer is started (step S08).

In the case where the kind of the thermal transfer sheet or the thermal transfer receiving sheet cannot be identified from the mark detection signal in the above-mentioned step S03, an error display is provided on the display part of the printer (step S06), or the printer operation is stopped.

Moreover, in the case where the thermal transfer sheet or the thermal transfer receiving sheet is determined not to be a genuine goods and it is a fake goods by the mark detection signal according to the fake goods determination in the above-mentioned step S04, an error display is provided on the display part of the printer (step S07), or the printer operation is stopped.

Although the kind identification and the fake goods determination are executed at the same time by the mark detection in the above-mentioned flow chart, a process may be carried out in such manner that the fake goods determination is first executed and then, in the case where the fake goods determination is preferable, the kind identification is executed later.

After identification of the kind and in the case it is recognized as a genuine goods in the above-mentioned steps S03 and S04, an image is formed on the thermal transfer receiving sheet by the thermal transfer printer with the coloring material to be transferred by heating the thermal transfer sheet. That is, a printing operation is started (step S08).

Then, the spool rotates in the thermal transfer printer during the printing operation, and it is confirmed whether or not the mark provided on the spool is detected by the sensor (step S09).

This embodiment is a case of executing all processes of the kind identification, the fake goods determination and the use amount calculating. Although a common mark can be used for detection in the kind identification and the fake goods determination, it is preferable to use a use amount calculation mark independent from the mark for detection in the kind identification process. The reason why the mark is independently used for calculation of use amount is that the kind identification is often executed not only by the selection out of two kinds but by the selection out of three or more kinds so that the mark is formed as a pattern in most cases and, to contrary the use amount calculation mark is often provided at one point by one kind on the surface of the spool.

In the case where detection is recognized as a result of the detection determination in the above-mentioned step S09 (S09: YES), the number of mark detection is compared with predetermined data in the discriminating part in the printer so as to calculate the use amount of the thermal transfer sheet or the thermal transfer receiving sheet (step S10).

Moreover, in the case where detection is not recognized as a result of the detection determination in the above-mentioned step S09 (S09: NO), the detection result is transmitted from the discrimination part in the printer to the control part and an error display is provided on the display part of the printer (step S11 ).

After executing the use amount calculation in the above-mentioned step S10, whether or not the use amount has reached a predetermined amount is examined (step S12 ).

In the case where attainment of the above-mentioned predetermined count number is recognized (S12 : YES), it is transmitted to the control part in the printer so as to light an alert lamp for the remaining amount alert on the display part of the printer or generate a noise alert as an alert buzzer (step S1 3), or stop the printer operation.

Figure 6:
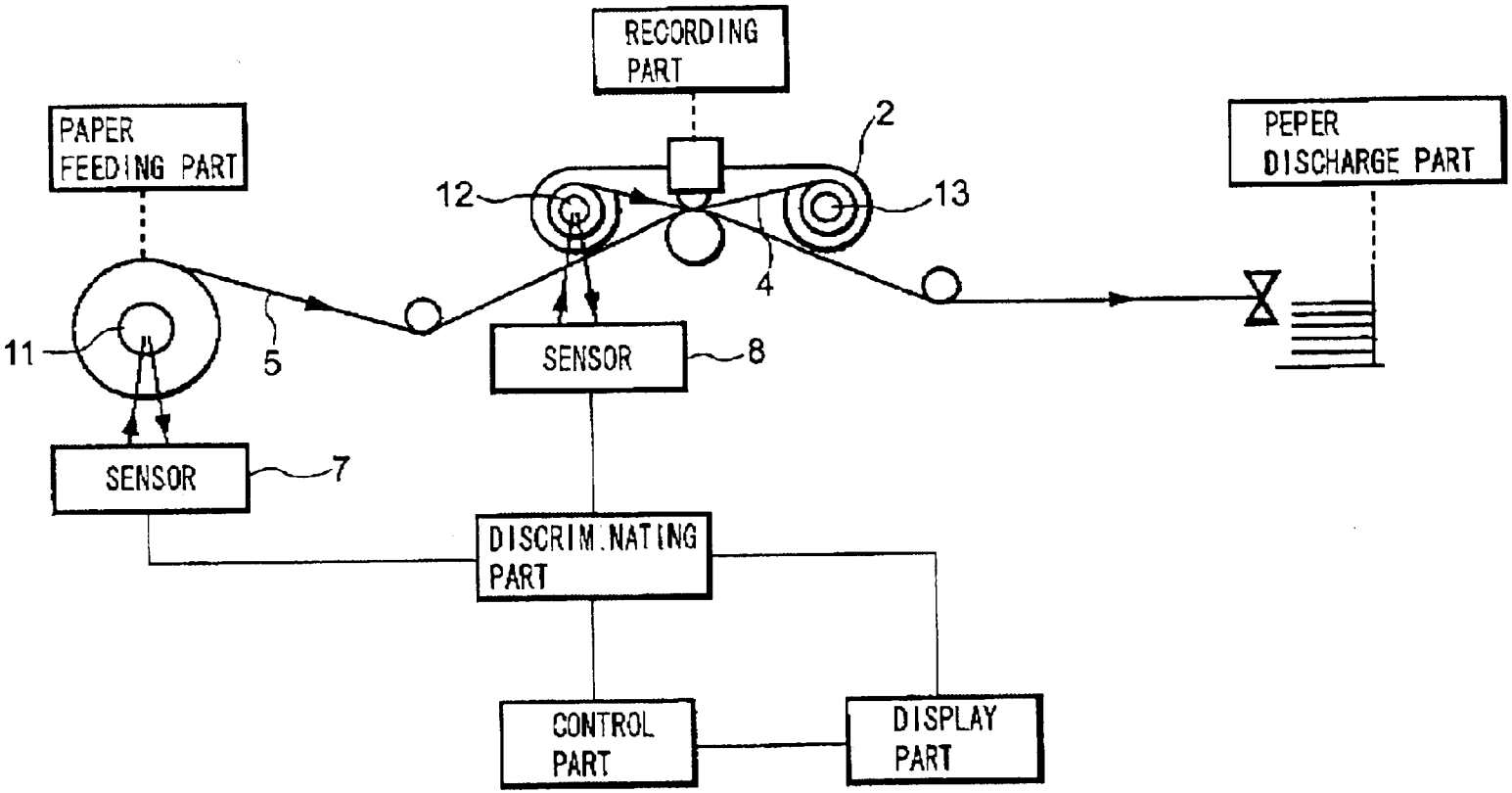
FIG. 6 is a block configuration diagram showing an embodiment of a printer of the present invention.

FIG. 6 is a block configuration diagram showing an embodiment of a printer of the present invention. According to the printer, a thermal transfer receiving sheet 5 is supplied from a paper feeding part in a state wound around a spool 11. A spool 13 bonded with the end of the wound up thermal transfer sheet 4 for winding up the thermal transfer sheet 4 in a state with a thermal transfer sheet 4 wound up on a supply spool 12 is provided and stored in a cassette 2. A recording part is placed around an opening part of the cassette 2, in which the thermal transfer sheet and the thermal transfer receiving sheet to be supplied at the opening part of the cassette 2 are brought contact with each other by pressure with a thermal head and a platen roll, and heated according to the image information.

The thermal transfer receiving sheet 5 with the image formed by the recording part is moved, cut into a sheet and discharged at a paper discharge part so as to be piled up.

At the paper supply part, a mark is provided to the spool 11 with the thermal transfer image receiving part 5 wound around. For detecting the mark and executing at least one discriminating process out of the kind identification, the fake goods determination and the use amount calculation of the thermal transfer receiving sheet 5 wound around on the spool from the detected signal, the discriminating part and the sensor 7 are interlocked. Moreover, the discriminating part and the control part for deciding the printing operation are also interlocked.

At the recording part, a pair of the thermal transfer sheet 4 and spools 12 and 13 are in a state that the thermal transfer sheets 4 is wound up on the supply spool 12 and the end of the thermal transfer sheet 4 is bonded with the spool 13 and they are is stored in the cassette 2 in such a state as it is. The thermal transfer receiving sheet 5 supplied from the paper feeding part and the thermal transfer sheet 4 in the cassette are heated by a thermal head in a state interposed between the thermal head and the platen roll at the opening part of the cassette 2 per each color of yellow, magenta, cyan, or the like according to the image information, whereby thermally transferring the coloring material of the thermal transfer sheet onto the thermal transfer receiving sheet. At this time, since the mark is provided on the spool 12 for winding and supporting the thermal transfer sheet 4, the mark can be detected by the sensor 8 so that, based on the detected signals, at least one discriminating process out of the kind identification, the fake goods determination and the use amount calculation is executed for the thermal transfer sheet wound up on the spool in the discriminating part.

Moreover, the discriminating part and the control part for deciding the printing operation are interlocked. Furthermore, the discriminating part and the control part are interlocked with the display part for displaying the alert, the sheet remaining amount, or the like in the printer.

The thermal transfer receiving sheet 5 with an image formed by the recording part is moved and cut from the continuous sheet into a leaf-like form and piled up at the discharge part.

In the above-mentioned printer, the mark provided on the spool with the thermal transfer receiving sheet and/or the thermal transfer sheet wound up contains a coloring material capable of absorbing an electromagnetic wave of a wavelength $\lambda 1$ and emitting an electromagnetic wave of a different wavelength $\lambda 2$.

The mark used in the present invention contains a coloring material which can absorb an electromagnetic wave of a wavelength $\lambda 1$ and emit an electromagnetic wave of a wavelength $\lambda 2$ different from the wavelength $\lambda 1$, and as examples thereof, the following coloring materials can be presented.

Coloring material 1: the electromagnetic wave of a wavelength $\lambda 1$ absorbed by the coloring material is an ultraviolet ray and the emitted electromagnetic wave of a different wavelength $\lambda 2$ is a visible light.

Coloring material 2: the electromagnetic wave of a wavelength $\lambda 1$ absorbed by the coloring material is an infrared ray and the emitted electromagnetic wave of a different wavelength $\lambda 2$ is an infrared ray.

Coloring material 3: the electromagnetic wave of a wavelength $\lambda 1$ absorbed by the coloring material is an infrared ray and the emitted electromagnetic wave of a different wavelength $\lambda 2$ is a visible light.

According to the above-mentioned classification, there are three kinds of the coloring materials, and it is particularly preferable that a mark containing the coloring material has the same color as the surface of spool or cassette supporting the spool, any of which is provided with the mark, namely the same color as that of a region other than the mark, particularly a region around the mark, or the mark is colorless or white, so that it is substantially invisible. That is, it is desirable that the mark can hardly be recognized with naked eyes with a visible light. In the case where the mark is recognized with a visible light and conspicuous, it is not preferable in terms of the external appearance of the spool, the cassette or the entire of the carrier device provided with the mark, and furthermore, it would lead to fake goods production to be produced easily, and an effect for preventing the fake goods is lowered.

In the present invention, "the same color" means that distinction between two colors is very difficult, and more preferably, virtually impossible by observation with the naked eyes under the visible light.

Often in a case where the chrominance (or color difference) ΔE between two colors is 4 or less, distinction of the colors becomes very difficult, and in a case where the chrominance ΔE is 3 or less, it can be said that those two colors are almost or virtually same in terms of color.

The chrominance ΔE is difference between two color values of $L_1a_1b_1$and $L_2a_2b_2$, which are to be given by measuring color indications of the two colors based on the CIE 1976(L*a*b*) color system, and then calculating with the following equation:

$$\Delta E=\{(L_1-L_2)^2+(a_1-a_2)^2+(b_1-b_2)^2\}^{1/2}$$

Among the above-mentioned three kinds of the coloring materials, the coloring material 1 emits a visible light according to excitation by an ultraviolet ray. For example, pigments of a sulfide, an oxide, an oxy sulfide, a silicate, or an aluminate of a zinc all of which are doped by one or more transitional metal elements or lanthanoid elements, can be presented. Specifically, zinc sulfides doped by a copper generates a green fluorescence. Zinc sulfides doped by a silver generates a blue fluorescence. An oxide, an oxy sulfide, a silicate or an aluminate of a zinc doped by a transitional metal or a lanthanoid generates a green, blue or red fluorescence.

Moreover, the above-mentioned coloring material 2 generates an infrared ray of a different wavelength λ2 according to excitation by an infrared ray of a wavelength λ1. For example, compositions of $LiNd_{0.9}Yb_{0.1}P_4O_{12}$, $LiBi_{0.2}Nd_{0.7}Yb_{0.1}P_4O_{12}$, $NaNd_{0.9}Yb_{0.1}P_4O_{12}$, $Nd_{0.8}Yb_{0.2}Na_5(WO_4)_4$, $Nd_{0.8}Yb_{0.2}Na_5(Mo_{0.6}W_{0.5}O_4)_4$, $Ce_{0.05}Gd_{0.05}Nd_{0.75}Yb_{0.15}Na_5(Mo_{0.7}Wo_{0.3}O_4)_4$, $Nd_{0.9}Yb_{0.1}A_{13}(BO_3)_4$, $Nd_{0.9}Yb_{0.1}A_{12.7}Cr_{0.3}(BO_3)_4$, $Nd_{0.5}Yb_{0.4}P_3O_{14}$, $Nd_{0.8}Yb_{0.2}K_3(PO_4)_2$, or the like can be presented.

The above-mentioned coloring material 3 emits a visible light according to excitation by an infrared ray. For example, it is particularly advantageous to use zinc sulfides, zinc sulfide cadmiums, alkaline earth metal aluminates, alkaline earth metal sulfides, or alkaline earth metal silicates, all of which are doped by one or more transitional metal elements or lanthanoid elements. Specifically, zinc sulfides doped by a copper generates a green fluorescence. Alkaline earth metal aluminates, alkaline earth metal sulfides, or alkaline earth metal silicates doped by a lanthanoid element generates a green, blue or red fluorescence. Zinc sulfide cadmiums doped by a copper generates a yellow, orange or red fluorescence, depending on the cadmium content.

Moreover, as the above-mentioned coloring material 3, fine particles containing rare earth element (it will be referred as "rare earth element containing fine particles" hereafter) which has the up conversion light emission according to excitation by a light of a wavelength in the range of 500 nm to 2,000 nm can be used.

Figure 7:
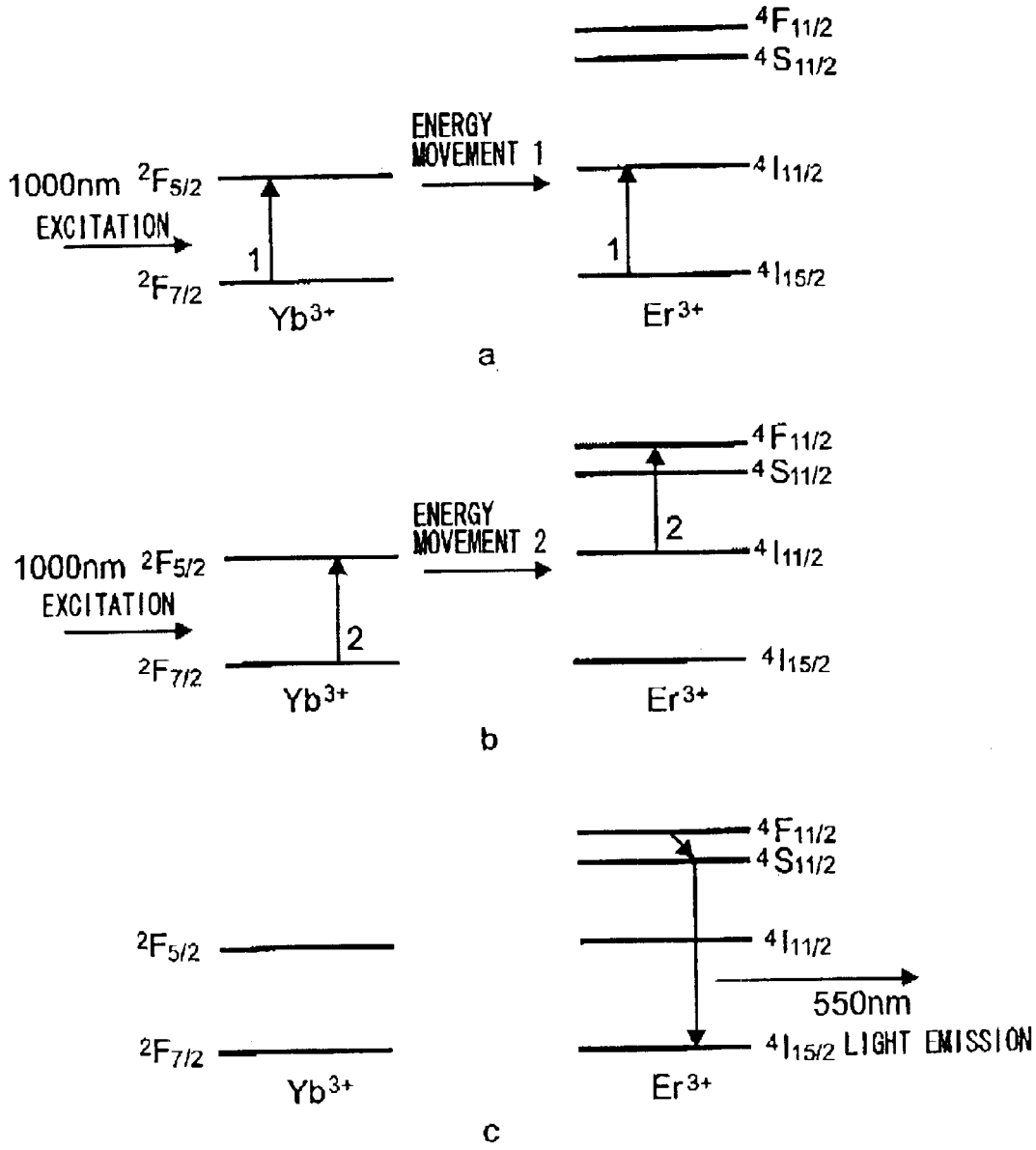
FIG. 7 is an explanatory diagram for explaining an up conversion light emission.

First, the up conversion light emission utilized in the present invention will be explained with reference to FIG. 7. FIG. 7 shows a system using two kinds of rare earth elements of an ytterbium (Yb) and an erbium (Er), using a 1,000 nm infrared ray irradiation as the exciting light. As shown in FIG. 7(*a*), the ytterbium is excited by the 1,000 nm exciting light so as to be moved from $^2F_{7/2}$ to the $^2F_{5/2}$ of a higher energy level. Then, the energy pushes up the energy level of the erbium from $^4I_{15/2}$ to $^4I_{11/2}$ according to the energy movement 1. Then, as shown in FIG. 7(*b*), the ytterbium is excited at the same time by the 1,000 nm exciting light so that the energy pushes up the energy level of the erbium further from $^4I_{11/2}$ to $^4F_{11/2}$ according to the energy movement 2. Then, as shown in FIG. 7(*c*), at the time the above-mentioned excited erbium returns to the ground state, it emits a 550 nm light.

Accordingly, in the case a coloring material excited by a 1,000 nm light emits a 550 nm light of a higher energy, that is, it emits a light of an energy higher than that of the exciting light, it is referred to as the up conversion light emission.

Figure 8:
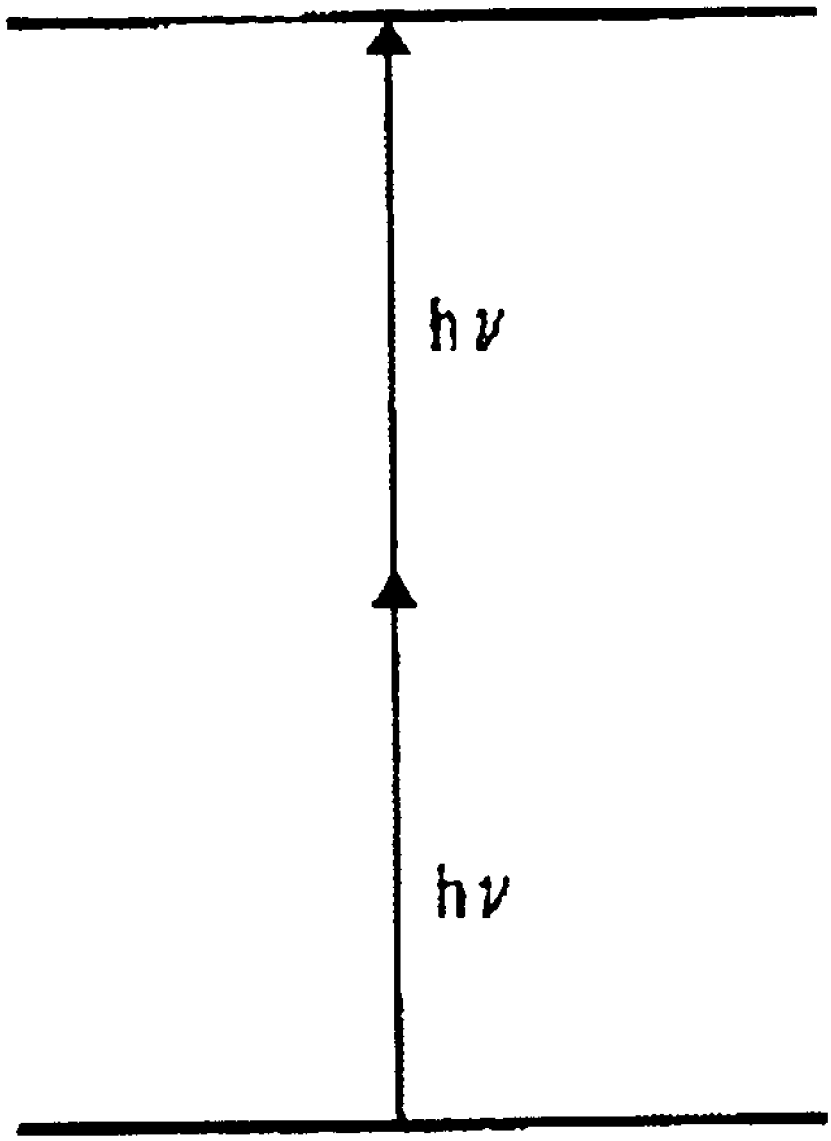
FIG. 8 is an explanatory diagram for explaining the two photon light emission.

The Si nano particles which generate the two photon excitation are excited only when the two photons are absorbed at the same time as shown in FIG. 8, and thus they are in principle different from the above-mentioned up conversion light emission. Moreover, the two photon excitation has a poor light emission efficiency due to the need of existence of the two photons at the same time, whereas the above-mentioned up conversion light emission does not require such a condition, so that it has an extremely high light emission efficiency compared with the Si nano particles for generating the two photon excitation.

Since a rare earth element capable of generating the up conversion light emission is used, a light with a high energy, such as an ultraviolet ray needs not be used for the excitation. That is, the wavelength of the light at the time of the light emission is in general preferably a visible light in terms of the detection easiness. Therefore, in the case of the up conversion light emission, a wavelength of a light to be used as the excitation light is longer than that of a light to be used as the detected light. Since the excitation light wavelength and the light emission wavelength can hardly be the same, detection can remarkably he facilitated.

Accordingly, since the rare earth element containing fine particles use the rare earths capable of executing the up conversion light emission, accurate detection of the mark can be enabled. Moreover, as compared with the two photon excitation, the light emission efficiency is extremely good. Furthermore, as compared with the case of using an organic fluorescent substance, since the storage stability or the like is good, stable and highly accurate detection can be enabled.

A rare earth element used in the present invention is not particularly limited as long as it can be excited by a light of a wavelength in a predetermined range so as to generate the up conversion light emission as mentioned above.

The wavelength range of the excitation light capable of generating the up conversion light emission is usually in the range of 500 nm to 2,000 nm. In particular, a wavelength in the range of 700 nm to 2,000 nm, and furthermore, a wavelength in the range of 800 to 1,600 nm is preferable.

As the rare earth elements, in general, rare earth elements to be a trivalent ion can be presented. In particular, rare earth elements such as an erbium (Er), a holmium (Ho), a praseodymium (Pr), a thulium (Tm), a neodymium (Nd), a gadolinium (Gd), a europium (Eu), an ytterbium (Yb), a samarium (Sm) and a cerium (Ce) can be used preferably.

In the present invention, the rare earth elements capable of generating the up conversion light emission as mentioned above may be used by one kind or two or more kinds at the same time. The mechanism of the up conversion light emission at the time of using one kind of the rare earth element can be explained with an example of the $Er^{3+}$ dope material, In the case where a 970 nm or 1,500 nm light is irradiated as the excitation light, visible light emission of 410 nm ($^2H_{9/2}$–$^4I_{15/2}$), 550 nm ($^4S_{3/2}$–$^4I_{15/2}$), 660 nm ($^4F_{9/2}$–$^4I_{15/2}$), or the like is provided based on the $Er^{3+}$ ion energy level via the up conversion process.

The rare earth element containing fine particles may be an organic substance, such as one formed in a state with a rare earth element contained in a complex, a dendrimer, or the like as long as they contain the rare earth elements in a state capable of providing the up conversion light emission, and thus they are not particularly limited. However, in general, those formed with the above-mentioned rare earth elements mixed in an inorganic base material are preferable because the rare earth elements can easily be contained in a state capable of providing the light emission.

As the inorganic base material, a material having the transparency with respect to the excitation light is preferable in terms of the light emission efficiency. Specifically, a halide such as a fluoride and a chloride, an oxide, a sulfide or the like can be used preferably.

From the viewpoint of the light emission efficiency, a halide can be used preferably. As such a halide, specifically, a barium chloride ($BaCl_2$), a lead chloride ($PbCl_2$), a lead fluoride ($PbF_2$), a cadmium fluoride ($CdF_2$), a lanthanum fluoride ($LaF_3$), an yttrium fluoride ($YF_3$), or the like can be presented. In particular, a barium chloride ($BaCl_2$), a lead chloride ($PbCl_2$) and an yttrium fluoride ($YF_3$) are preferable.

In contrast, as the base material with a high environmental resistance stable with respect to the moisture content or the like, an oxide can be presented. As the oxide, specifically, an yttrium oxide ($Y_2O_3$), an aluminum oxide ($Al_2O_3$), a silicon oxide ($Sio_2$), a tantalum oxide ($Ta_2O_5$) or the like can be presented. In particular, an yttrium oxide ($Y_2O_3$) is preferable.

In the case where a halide is used as the base material of the fine particles, it is preferable to form a protection layer in the surroundings. That is, since a halide is in general unstable with respect to water or the like, and thus in the case where it is used as it is as the fine particles, accurate detection may not be carried out. In this case, composite fine particles with a covering material having the water proof property, or the like formed around the fine particles comprising a halide as the base material can be used. As the covering material in this case, the above-mentioned oxides can be used preferably.

As to the method for introducing the rare earths to the base material, for a halide such as a barium chloride ($BaCl_2$), methods described in Japanese Patent Application Laid Open No. 9-208947, or the document ("Efficient 1.5 mm to visible Up Conversion in $Er^{3+}$ Doped Halide Phosphors" Junichi Ohwaki, et al., p. 1334–1337, JAPANESE JOURNAL OF APPLIED PHYSICS, Vol. 31 part 2 no. 3A, 1Mar. 1994) can be presented.

Moreover, for an oxide, methods described in Japanese Patent Application Laid Open No. 7-3261 or the document ("Green up Conversion Fluorescence in $Er^{3+}$ Doped $Ta_2O_5$ Heated Gel" Kazuo Kojimaetal. Vol. 67 (23), 4Dec. 1995; "Relationship Between Optical Properties and Crystallinity of Nanometer $Y_2O_3$; Eu Phosphor" APPLIED PHYSICS LETTERS, Vol. 76, No. 12 , p. 1549–1551, 20Mar. 2000) can be presented.

The introduction amount of the rare earth element in the above-mentioned base material differs drastically depending on the kind of the rare earth element, the kind of the base material, and the required degree of the light emission, and thus it can be determined optionally, according to the various conditions.

Moreover, the size of the rare earth element containing fine particles is preferably in the range of a 1 nm to 100 nm mean particle size.

Furthermore, the rare earth element having the up conversion light emission is characterized in that an emission color of the up conversion light emission varies depending on a composition of the rare earth element in the fine particles including a combination and compounding ratio of the rare earth elements. Therefore the up conversion light emission can be adjusted to a specific emission color by changing a composition of the fine particles.

By utilizing such a characteristics of the rare earth element, marks can be formed with rare earth element containing fine particles having different light emission colors to plural spools or cassettes respectively so as to correspond to the kinds of spools or cassettes, whereby executing a specific identification of kind and determination of fake goods among a plural kinds of the goods. That is, an operation of the kind identification or the fake goods determination can be enabled by allotting a specific up conversion light emission per each kind of spools or cassettes.

A change in a composition of the above-mentioned rare earth element may be executed specifically by using one kind of the rare earth elements or a combination of two or more different kinds of the rare earth elements with respect to a mark to be provided on a spool or a cassette.

As the production method for the above-mentioned rare earth element containing fine particles, an vaporization in gas phase method including a high frequency plasma method, a sputtering method, a glass crystallization method, a chemical deposition method, a reversed micelle method, a sol-gel method, and a method similar thereto, a precipitation method including a hydrothermal synthesis method and a co-precipitation method, a spray method or the like can be presented.

As a method for providing a mark containing such a coloring material on a part or the entirety of the surface of a spool, a cassette for supporting the spool or another part of the carrier device, various kinds of printing methods such as offset printing, gravure printing, and letterpress printing, an ink-jet recording method, a transfer method using a transfer foil with a mark formed or the like can be presented.

EXAMPLES

Hereinafter, with reference to examples, the present invention will be explained further specifically. In the description, the part and % are based on the weight.

<Coating Solution for Producing Invisible Mark>

(1) "Ultraviolet-visible type" (coloring material 1 type)

| | |
|---|---|
| Coloring material ($Sr_3(PO_4)_3Cl$: Eu) | 20 parts |
| Polyester resin (Vylon 200, produced by Toyobo Co., Ltd.) | 150 parts |
| Methyl ethyl ketone | 250 parts |
| Toluene | 250 parts |

(2) "Infrared-infrared type" (coloring material 2 type)

| | |
|---|---|
| Coloring material ($LiNdP_4O_{12}$) | 20 parts |
| Polyester resin (Vylon 200, produced by Toyobo Co., Ltd.) | 150 parts |
| Methyl ethyl ketone | 250 parts |
| Toluene | 250 parts |

(3) "Infrared-visible type (coloring material 3 type)"

| | |
|---|---|
| Coloring material ($YF_3$:Yb + Tm) | 20 parts |
| Polyester resin (Vylon 200, produced by Toyobo Co., Ltd.) | 150 parts |
| Methyl ethyl ketone | 250 parts |
| Toluene | 250 parts |

<Production of a Spool with an Invisible Mark>

A spool forming material with a ratio of 100 parts of a polystyrene resin and 10 parts of a white pigment (titanium oxide) is melted and kneaded, and a cylindrical spool having a 25.4 mm inner diameter, 31.4 mm outside diameter and a 200 mm length was produced using an extrusion molding machine. Next, a 2 mm diameter round mark was printed on one end face of the spool by a flexiso printing method using the above-mentioned coating solution (1) for producing the mark. Although the provided mark was not completely colorless and transparent, it has a substantially white color similar to the part other than the mark so that it was substantially invisible.

<Mark Detection>

Using a commercially available black light (light emission wavelength 366 nm), an ultraviolet ray was irradiated to the above-mentioned spool, so that blue light emission was visually confirmed.

A spool with a mark was produced in the same manner as in the above-mentioned production of a spool with a mark except that a coating solution (2), (3) was used instead of the mark production coating solution (1). As shown in the Table below, in the case where an electromagnetic wave was irradiated to the obtained marks by a light source suitable to each mark, emission of an electromagnetic wave of a wavelength inherent to the coloring material contained in the mark was confirmed.

TABLE 1

Absorption wavelength, light emission wavelength, light emission color of each invisible mark

| Invisible mark coating solution | Absorption Wavelength (excitation wavelength) | Light Emission Wavelength | Light Emission Color |
|---|---|---|---|
| (1) | 365 nm | 460 nm | Blue |
| (2) | 780 nm | 1050 nm | Invisible |
| (3) | 850 nm | 525 nm | Green |

Moreover, the below-mentioned coating solutions for producing mark were prepared.

<Coating Solution for Producing Invisible Mark>

(4) "Infrared-visible type" (coloring material 3 type)

| | |
|---|---|
| Rare earth element containing fine particles ($Y_2O_3$: Yb, Er fine particles: mean particle size about 30 nm) | 20 parts |
| Polyester resin (Vylon 200, produced by Toyobo Co., Ltd.) | 150 parts |
| Methyl ethyl ketone | 250 parts |
| Toluene | 250 parts |

The above-mentioned rare earth element containing fine particles emit a red light of $Er^{3+}$ in the vicinity of 660 nm according to the semiconductor laser excitation (980 nm).

(5) "Infrared-visible type" (coloring material 3 type)

| | |
|---|---|
| Rare earth element containing fine particles ($Y_2O_3$: Er fine particles: mean particle size about 30 nm) | 20 parts |
| Polyester resin (Vylon 200, produced by Toyobo Co., Ltd.) | 150 parts |
| Methyl ethyl ketone | 250 parts |
| Toluene | 250 parts |

The above-mentioned rare earth element containing fine particles emit a green light of $Er^{3+}$ in the vicinity of 550 nm according to the semiconductor laser excitation (980 nm).

(6) "Infrared-visible type" (coloring material 3 type)

| | |
|---|---|
| Rare earth element conteining fine particles ($Y_2O_3$: Yb, Tm fine particles: mean particle size about 30 nm) | 20 parts |
| Polyester resin (Vylon 200, produced by Toyobo Co., Ltd.) | 150 parts |
| Methyl ethyl ketone | 250 parts |
| Toluene | 250 parts |

The above-mentioned rare earth element containing fine particles emit a blue light of $Tm^{3+}$ in the vicinity of 480 nm according to the semiconductor laser excitation (980 nm).

<Production of a Spool with an Invisible Mark>

In the same manner as in the case of the spools with an invisible mark produced with the above-mentioned mark producing coating solutions (1) to (3), production was executed with the coating solution changed to the above-mentioned coating solutions (4). Although the provided mark was not completely colorless and transparent, it has a substantially white color similar to the part other than the mark so that it was substantially invisible.

<Mark Detection>

Using a semiconductor laser (light emission wavelength 980 nm), an infrared ray was irradiated to the above-mentioned spool, so that red light emission was visually confirmed.

In the same manner, an infrared ray was irradiated to the marks produced using the coating solutions (5), (6) according to a semiconductor laser (light emission wavelength 980 nm), the electromagnetic wave of a wavelength inherent to the coloring material contained in the mark was confirmed.

<Use Amount Detection>

The use amount detection can be executed, for example, according to the detection flow shown in FIG. 5, using a thermal transfer sheet supported on a spool with a mark formed using the above-mentioned coating solution (1) in accordance with the position and shape shown in FIG. 4, a light source disposed at a position capable of irradiating an ultraviolet ray to the mark part of the spool when the thermal transfer sheet is mounted on the printer, and a photo sensor having the sensitivity in a visible light region disposed at a position capable of detecting the light emission from the mark generated by the irradiation of the ultraviolet ray.

As heretofore described, according to the present invention, since a mark is provided in a part or the entirety of the surface of on a spool for winding and supporting a thermal transfer sheet or a thermal transfer receiving sheet, or a cassette for supporting the spool, or another part of the carrier device by using a coloring material which can absorb an electromagnetic wave of a wavelength λ1 and emit an electromagnetic wave of a wavelength λ2 different from the wavelength λ1, the kind identification, the fake goods determination and the use amount calculation can be executed appropriately without increase in the kinds of the spool or the cassette or deteriorating the external appearance.

Moreover, the spool or the cassette and the carrier device comprising them achieved by the present invention does not cause an increase in the production cost or the external appearance deterioration.

What is claimed is:

1. A carrier device for a thermal transfer medium comprising a spool for winding and supporting a thermal transfer sheet or a thermal transfer receiving sheet, wherein a mark containing a coloring material which absorbs an electromagnetic wave of a predetermined wavelength λ1 and emitting an electromagnetic wave of a wavelength λ2 different from the wavelength λ1 is provided on a region in a surface of the carrier device capable of being irradiated with an electromagnetic wave, and wherein the coloring material absorbs an ultraviolet ray as the electromagnetic wave of the wavelength λ1, and emits a visible light as the electromagnetic wave of the wavelength λ2.

2. A carrier device for a thermal transfer medium according to claim 1, wherein the mark is provided on a part or the entirety of the surface of the spool.

3. A carrier device for a thermal transfer medium according to claim 1, wherein the carrier device further comprises a cassette for supporting the spool, and the mark is provided on a part or the entirety of the surface of the cassette.

4. A carrier device according to claim 1, wherein the mark has the same color as the part other than the mark, or colorless or white so as to be substantially invisible.

5. A discrimination method for a thermal transfer medium comprising steps of:

providing a carrier device for a thermal transfer medium according to claim 1; irradiating the mark with the electromagnetic wave of the wavelength λ1;

detecting the mark by confirming the electromagnetic wave of the wavelength λ2 emitted from the mark; and, executing at least one process among an identification of the kind, a determination of the fake goods and a calculation of the use amount for the thermal sheet of the thermal transfer receiving sheet based on a detection of the mark.

6. A printer comprising: a sensor for detecting a mark by irradiating the mark with an electromagnetic wave of a wavelength λ1 and receiving an electromagnetic wave of a wavelength λ2 emitted from the mark, when a carrier device according to claim 1 is mounted on the printer, a discriminating part for executing at least one process among an identification of the kind, a determination of the fake goods and a calculation of the used amount for the thermal transfer sheet of the thermal transfer receiving sheet based on a detection signal of the mark, and, a control part for deciding the printing operation based on the discriminating result.

7. A carried device for a thermal transfer medium comprising a spool for winding and supporting a thermal transfer sheet or a thermal transfer receiving sheet, wherein a mark containing a coloring material which absorbs an electromagnetic wave of a predetermined wavelength λ1 and emitting an electromagnetic wave of a wavelength λ2 different from the wavelength λ1 is provided on a region in a surface of the carrier device capable of being irradiated with an electromagnetic wave, and wherein the coloring material absorbs an infrared ray as the electromagnetic wave of the wavelength λ1, and emits a visible light as the electromagnetic wave of the wavelength λ2.

8. A carrier device according to claim 7, wherein the coloring material is made of fine particles containing rare earth element which has the up conversion light emission to be excited by a light of a wavelength in the range of 500 nm to 2,000 nm.

9. A carrier device according to claim 8, wherein the fine particles containing rare earth element have a mean particle size in the range of 1 nm to 100 nm.

10. A carrier device according to claim 8, wherein the fine particles containing rare earth element contains a base material composed of at least a halide and/or an oxide and the rare earth element having the up conversion light emission.

11. A carrier device according to claim 8, wherein the rare earth element in the fine particles is at least one selected from the group consisting of an erbium (Er), a holmium (Ho), a praseodymium (Pr), a thulium (Tm), a neodymium (Nd), a gadolinium (Gd), an europium (Eu), an ytterbium (Yb), a samarium (Sm) and a cerium.

12. A carrier device according to claim 8, wherein the mark has a specific emission color of the up conversion light emission corresponding to a composition of the rare earth element in the fine particles.

13. A carrier device for a thermal transfer medium according to claim 7, wherein the mark is provided on a part or the entirety of the surface of the spool.

14. A carrier device for a thermal transfer medium according to claim 7, wherein the carrier device further comprises a cassette for supporting the spool, and the mark is provided on a part or the entirety of the surface of the cassette.

15. A carrier device according to claim 7, wherein the mark has the same color as the part other than the mark, or colorless or white so as to be substantially invisible.

16. A discrimination method for a thermal transfer medium comprising steps of:

providing a carrier device for a thermal transfer medium according to claim 7; irradiating the mark with the electromagnetic wave of the wavelength λ2;

detecting the mark by confirming the electromagnetic wave of the wavelength λ2 emitted from the mark; and, executing at least one process among an identification of the kind, a determination of the fake goods and a calculation of the use amount for the thermal transfer sheet or the thermal transfer receiving sheet based on a detection of the mark.

17. A printer comprising:

sensor for detecting a mark by irradiating the mark with an electromagnetic wave of a wavelength λ1 and receiving an electromagnetic wave of a wavelength λ2 emitted from the mark, when a carrier device according to claim 7 is mounted on the printer, a discriminating part for executing at least one process among an identification of the kind, a determination of the fake goods and a calculation of the use amount for the thermal transfer sheet or the thermal transfer receiving sheet based on a detection signal of the mark, and, a control part for deciding the printing operation based on the discriminating result.

* * * * *